United States Patent [19]

King et al.

[11] 4,176,606

[45] Dec. 4, 1979

[54] PYROTECHNIC DEVICES

[75] Inventors: Colin M. King, Winterbourne Stoke; Michael R. Goddard, Gt. Wishford; Dudley C. Murray, Salisbury, all of England

[73] Assignee: Pains-Wessex Limited, England

[21] Appl. No.: 859,400

[22] Filed: Dec. 12, 1977

[30] Foreign Application Priority Data

Jan. 6, 1977 [GB] United Kingdom ..... 319/77

[51] Int. Cl.[2] ..... F42B 4/26

[52] U.S. Cl. ..... 102/37.4; 102/37.8; 42/1 Z

[58] Field of Search ..... 102/37.4, 37.8, 204, 102/222, 260, 261, 27 Z; 42/1 G, 1 Z

[56] References Cited

U.S. PATENT DOCUMENTS

| | | | |
|---|---|---|---|
| 2,519,123 | 8/1950 | Dwyer et al. | 42/1 Z |
| 3,654,867 | 4/1972 | Murray | 102/37.8 |
| 3,707,793 | 1/1973 | Holton | 42/1 Z |

*Primary Examiner*—Verlin R. Pendegrass

*Attorney, Agent, or Firm*—Leydig, Voit, Osann, Mayer & Holt, Ltd.

[57] ABSTRACT

A hand-operated pyrotechnic device has a tubular handle and, slidable telescopically therein, a tubular striker supporting a firing pin. The striker is rotatable from a 'Safe' position to an 'Armed' position, and movable axially, by impact, from the 'Armed' position to a 'Fire' position. A resilient detent prevents movement from the 'Armed' to the 'Fire' position unless the applied impact force exceeds a predetermined value. Further resilient detents prevent unintentional arming of the device.

9 Claims, 5 Drawing Figures

PYROTECHNIC DEVICES

FIELD OF THE INVENTION

The present invention relates to pyrotechnic devices suitable for being held in the hand. An example of a pyrotechnic device to which the present invention is applicable is a hand flare for marine use.

More particularly the invention relates to a pyrotechnic device which is operated by hand and includes a safety device for ensuring that the pyrotechnic device is not unintentionally ignited.

DESCRIPTION OF THE PRIOR ART

A hand-operated pyrotechnic device is known which comprises a first tubular member for containing a charge of pyrotechnic material, a second tubular member which supports and/or forms an extension of said first tubular member and a third member fitted telescopically to said second tubular member, means for locating a primer for igniting the pyrotechnic material, a firing pin movble to actuate the primer and a safety interlock comprising an L shaped guide member and a follower member engaging in said guide member, the guide member of the interlock being provided on the second tubular member and the follower on said third member, one portion of the L shaped guide extending parallel to the axis of the second and third members and the other portion extending circumferentially of the second and third members to define a restricted path for relative movement of the second and third members which extends circumferentially from a 'Safe' position to an 'Armed' position, and axially from said 'Armed' position to a 'Fire' position.

In the known pyrotechnic device, the firing pin is slidably mounted in the second tubular member and is biassed by a helical spring which extends between the firing pin and the third member. In the initial stage of axial movement of the third member into the second member, a detent ball holds the firing pin stationary while the helical spring is compressed. When the third member reaches a predetermined axial position relative to the second tubular member, a recess of the third member comes into register with the detent ball thereby allowing the detent ball to move laterally away from, and so release, the firing pin.

The released firing pin is then driven by the compressed helical spring pin towards the primer.

In a pyrotechnic device which employs a biassing spring and a movable detent ball there is an inevitable danger of malfunction due to breakage of the spring, and failure of the detent ball to release the firing pin due to tolerance errors, manufacturing errors, corrosion, or ingress of dirt.

OBJECTS AND SUMMARY OF THE INVENTION

It is a primary object of the invention to provide a hand-operated pyrotechnic device having a safety interlock which affords a high degree of safety against unintentional operation but is relatively inexpensive to manufacture by reason of having a very small number of moving parts.

According to the present invention, there is provided a hand-operable pyrotechnic device for containing a charge of pyrotechnic material, the device having a firing mechanism provided with a safety device and operable to detonate a primer thereby to ignite the pyrotechnic material, the firing mechanism comprising two members which are movable relatively to one another in a rotational sense when located in a predetermined relative axial position, and in an axial sense when located in a predetermined relative rotational position, the mechanism also including a detent which is effective to oppose said axial movement until the force applied to cause said relative axial movement exceeds a predetermined value, the firing mechanism further comprising a firing pin secured to one of said members and being movable, by the relative axial movement of the said two members, to contact a primer when said primer has been located in position in the other said member.

The present invention also provide a hand-operable pyrotechnic device comprising a first tubular member for containing a charge of pyrotechnic material, a second tubular member which supports and/or forms an extension of said first tubular member and a third member fitted telescopically to said second tubular member, means defining a location for a primer for igniting the pyrotechnic material, a firing pin movable towards the primer location for actuating a primer when located therein and a safety device comprising an L shaped guide portion and a follower portion engaging in said guide portion, said portions of the safety device being provided respectively on the second and third members, the L shaped guide portion having an axial arm which extends parallel to the axis of the members and a circumferential arm which extends circumferentially of the members to define a restricted path for relative movement of the second and third members which extends circumferentially from a 'Safe' position to an 'Armed' position, and axially from said 'Armed' position to a 'Fire' position, the firing pin being secured to one of said second and third members for movement therewith relative to a primer location fixed with respect to the other of said members in response to said axial relative movement of the second and third members from said 'Armed' to said 'Fire' position, and a detent associated with the axial arm of said guide portion which provides a resilient obstruction to relative axial movement of the second and third members and of the firing pin relative to the primer and hence prevents ignition of the primer if the force applied to the firing pin is below a predetermined minimum.

DESCRIPTION OF PREFERRED EMBODIMENTS

Figure 1:
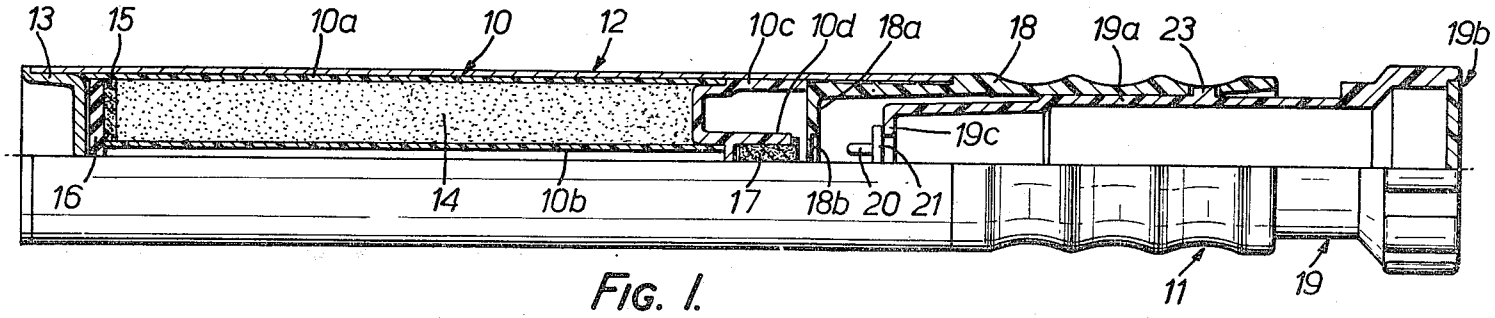
FIG. 1 is an axial section through the hand flare.

As shown in FIG. 1 the hand flare comprises a tubular container 10 for pyrotechnic composition and a handle and striker assembly 11 which incorporates a striker mechanism. The assembly 11 is of generally cylindrical construction and is secured in end-to-end relationship with the container 10 by an outer tube 12, conveniently of metal, which envelops the container 10 and into which the inner end of the handle and striker assembly is fitted.

The tubular composition container 10, which is conveniently made of plastics, has an outer tubular wall 10*a*, an inner tubular wall 10*b* and an annular inner end wall 10*c* into which the adjacent ends of tubular walls 10*a* and 10*b* are fitted. The opposite end of the container is closed by an end cap 13 which fits into the outer tube 12 and abuts the adjacent end of the tubular wall 10*a*. The annular space between the inner and outer tubular walls 10*a* and 10*b*, contains a charge 14 of pyrotechnic composition at the cap end of which is a charge of igniter composition 15. A washer 16, for example of natural or synthetic rubber, is fitted between the end cap 13 and the adjacent end of the inner tubular wall 10*b* and extends across the igniter charge 15. Means are provided to ensure that a flame travelling down the inner tubular wall 10*b* can reach the igniter charge 15. Such means can comprise a cambric disc disposed across the inner face of the washer 16, or a coating of gunpowder on the inner face of the washer, or serrations on the end of the inner tubular wall 10*b*.

At the opposite end of the tubular wall 10*b* a rimfire cap or other primer 17 is located. This primer is conveniently fitted into a sleeve shaped member 10*d* located at the centre of and forming an integral part of the end wall 10*c*.

The handle and striker assembly 11 comprise a tubular handgrip 18 which is conveniently made of plastics material, and is closed at its inner end by an integrally moulded end wall or web 18*a* having a central area of reduced thickness to form a diaphragm 18*b*. Fitted telescopically within the handgrip 18 is a tubular striker 19.

The striker 19, which is conveniently made of plastics material, comprises a cylindrical tubular portion 19*a* fitting closely within the handgrip 18, the outer end of the cylindrical portion 19*a* of the striker supporting an enlarged knob 19*b* formed with a knurled periphery, and the inner end of the cylindrical portion tapering to an end wall 19*c* on which a firing pin 20 is supported. The firing pin 20 is conveniently mounted on a metal disc 21 with the firing pin 20 extending perpendicular to its surface, the disc being secured to the end wall 19*c*. When the primer is a rimfire cap the firing pin will be offset from the axis of the hand flare as shown in FIG. 1. In the case of a centre-fire or stab primer, the firing pin will be aligned with the centre of the primer when the latter is struck.

Figure 3:
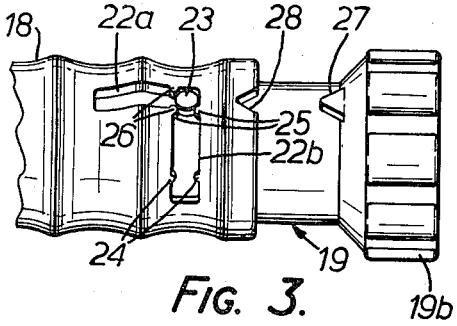
FIGS. 3 and 4 are side elevations of a part of the hand flare showing the striker in an 'Armed' position and in a 'Fire' position respectively.
Figure 4:
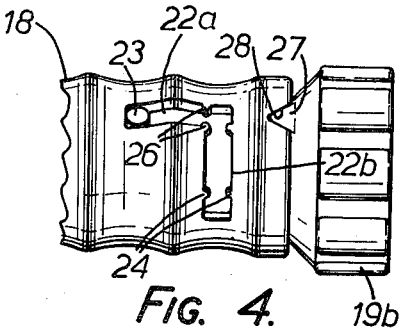
Figure 5:
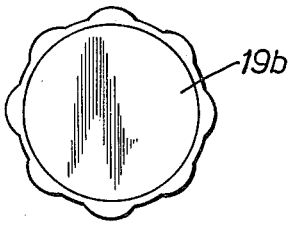
FIG. 5 is an end elevation of the hand flare.

The tubular striker 19 is rotatable and axially slidable within the tubular handgrip 18. To reduce friction between the contacting surfaces of the striker and the handgrip, longitudinally extending flats can be formed on the surface of the striker. The rotational and axial movement of the striker is defined by an L shaped guide follower in the handgrip 18 which is engaged by a guide follower in the form of a peg 23 projecting from the outer surface of the tubular striker 19. The L shaped guide slot has an axial arm 22*a* and a circumferential arm 22*b*, and the location of the peg 23 within the slot determines the state of operation of the striker. Thus when the peg 23 is located at the outer extremity of the circumferential arm 22*b*, (as in FIG. 2) the striker is in a 'Safe' position in which the firing pin 20 cannot strike the primer 17. When the peg 23 is at the junction of the two arms, 22*a*, 22*b* (as in FIG. 3) the striker is in an 'Armed' position from which it can be moved by an axially directed blow into a 'Fire' position in which the firing pin strikes the primer (as in FIG. 4).

In order to provide a safety device to prevent unintentional operation of the hand flare, separate sprung detents 24, 25, 26 are provided to resist movement of the peg out of the 'Safe' position, into the 'Armed' position, and out of the 'Armed' position in the firing direction.

In the illustrated embodiment, these detents are formed by three pairs of projections from the boundary walls of the guide slot, each pair forming a neck or constriction in the slot through which the peg 23 can pass only after sufficient force has been applied to the peg to force it through the neck. Although this construction is suitable when the material forming the handgrip is a resilient plastics material, resilient tongues or other configurations may be preferred if the material defining the slot is less resilient, for example, metal.

To assist in ensuring that the striker pin engages the primer only after rotation of the striker into the 'Armed' position, an arrowhead shaped projection 27 extends axially from the knob towards the outer end of the handgrip, and a V shaped recess 28 is provided in the handgrip into which the projection 27 can be received but only when the striker has been rotated into the 'Armed' position. In any other rotational position of the striker, the projection 27 would lie opposite an unrecessed portion of the rim of the handgrip and would prevent the striker from being driven fully into the handgrip even if the blow applied to the striker had destroyed the safety device formed by engagement of the peg 23 in the L shaped slot 22.

Figure 2:
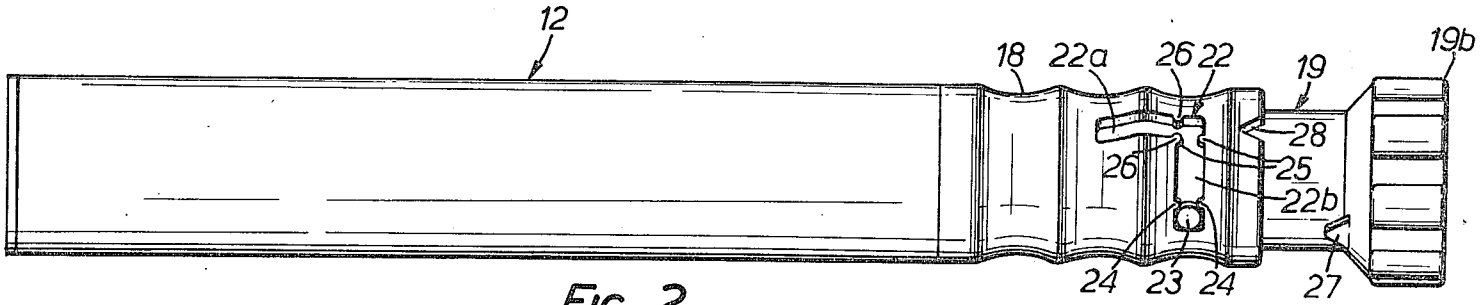
FIG. 2 is a side elevation of the hand flare of FIG. 1 showing a striker in a 'Safe' position.

In operation of the hand flare, the striker 19 is normally located in the 'Safe' position of FIG. 2. If the flare is held in one hand by the operator, the striker can be rotated by the other hand of the operator into the 'Armed' position of FIG. 3 by a rotationaly force sufficient to cause flexing of the detents 24 as the peg is forced away from the closed end of the circumferential arm 22*b* of the slot and also flexing of the detents 25 at the opposite end of arm 22*b*. In order then to fire the flare, the user must force the striker 19 inwardly by a blow applied by hand to the knob 19*b*, or by striking the knob 19*b* on a hand surface, with sufficient force to cause the peg 23 to be driven through the detents 26 in the axial arm 22*a* of the slot and to cause the firing pin 20 to penetrate the diaphragm 18*b* and detonate the primer 17. Upon detonation, a flame will travel down the tubular wall 10*b* and ignite the igniter charge 15 adjacent the washer 16 which in turn will ignite the flare composition 14. The end cap 13 will be blown off in the course of combustion.

In a modified form of the handflare, not illustrated herein, the L shaped guide can be formed as a slot in the striker and the peg formed on the handgrip to project radially inwardly into the L shaped slot in the striker.

In either of the constructions described above, the L shaped guide can be a groove in the handgrip or striker instead of a slot extending fully through the wall of the handgrip or striker. In the case of a groove, the detents can be provided either on the sides of the groove, or in the base of the groove. When detents are formed in the base of the groove, these will act as ramps over which the peg will rise by flexure of the wall on which the peg is formed or on which the detent is formed, or by flexure of both such walls.

The constructions described above enable a hand flare to be produced which is safe against operation as a result of being dropped, is easy to operate by an operator with cold or wet hands or wearing gloves, requires a minimum of operations to fire, does not become too hot to hold during operation, and does not discharge burning dross on to the hand of the operator.

Moreover, by providing, inter alia, a sealed ignition system the flare can be made to withstand 10 cm of water for 1 minute in ready to fire conditions.

Again the construction renders the hand flare suitable for semi-automatic assembly.

Provision can be made in the handgrip for a lanyard to be fitted; for examply an eyelet can be provided. Such a lanyard, if fitted to the upper end of the handle, could be wrapped around the hand of the user to prevent loss of the flare when striking it which is liable to occur when the hands are very cold and/or wet. Again, instead of the flare being kept in store, such a lanyard could be used to secure the flare to a person as a personal signal which would be useful if the person were swept overboard.

We claim:

1. A hand-operable pyrotechnic device for containing a charge of pyrotechnic material, the device having a firing mechanism provided with a safety device and operable to detonate a primer thereby to ignite the pyrotechnic material, the firing mechanism comprising two members which are movable relatively to one another in a rotational sense from a 'Safe' to an 'Armed' position when located in a predetermined relative axial position, and in an axial sense from an 'Armed' to a 'Fire' position when located in a predetermined relative rotational position, the mechanism also including a resilient detent which is effective to oppose said axial movement into the 'Fire' position until the force applied to cause said relative axial movement exceeds a predetermined value, the firing mechanism further comprising a firing pin secured to one of said members and being movable, by the relative axial movement of the said two members, to contact a primer when said primer has been located in position in the other said member.

2. A hand-operable pyrotechnic device comprising a first tubular member for containing a charge of pyrotechnic material, a second tubular member which supports and/or forms an extension of said first tubular member and a third member fitted telescopically to said second tubular member, means defining a location for a primer for igniting the pyrotechnic material, a firing pin movable towards the primer location for actuating a primer when located therein and a safety device comprising an L shaped guide portion and a follower portion engaging in said guide portion, said portions of the safety device being provided respectively on the second and third members, the L shaped guide portion having an axial arm which extends parallel to the axis of the members and a circumferential arm which extends circumferentially of the members to define a restricted path for relative movement of the second and third members which extends circumferentially from a 'Safe' position to an 'Armed' position, and axially from said 'Armed' position to a 'Fire' position, the firing pin being secured to one of said second and third members for movement therewith relative to a primer location fixed with respect to the other of said members in response to said axial relative movement of the second and third members from said 'Armed' to said 'Fire' position, and a detent associated with the axial arm of said guide portion which provides a resilient obstruction to relative axial movement of the second and third members and of the firing pin relative to the primer and hence prevents ignition of the primer if the force applied to the firing pin is below a predetermined minimum.

3. A pyrotechnic device according to claim 2 wherein a second detent is provided which is associated with the circumferential arm of said guide portion and which provides a resilient obstruction to relative rotational movement of the second and third members from said 'Safe' position to said 'Armed' position.

4. A pyrotechnic device according to claim 3 wherein a third detent is provided in said circumferential arm of the guide portion, the second and third detents being located at each end thereof.

5. A pyrotechnic device according to claim 2 wherein the third member is tubular, closed at its outer end and fits slidingly within the second tubular member, and said second tubular member is shaped to form a hand grip.

6. A pyrotechnic device according to claim 2 wherein a membrane of plastics or other material is provided between the primer location and firing pin and is capable of being penetrated by the pin in response to the pin striking the membrane with a force in excess of a predetermined value.

7. A pyrotechnic device according to claim 2 wherein said second and third members comprise tubes of plastics or other resilient material one fitting telescopically within the other, one of said tubes having therein an L shaped slot forming said guide portion, the said detent being formed integrally with said one plastics tube and located within the slot, and the follower portion being formed integrally with the other tube.

8. A pyrotechnic device according to claim 7 wherein said detent is formed by a pair of protrusions extending towards one another into the path of the follower portion from opposite sides of the slot and forming a neck in the slot.

9. A pyrotechnic device according to claim 2 including a second safety device for preventing operation of the pyrotechnic device in the event of failure of the first-mentioned safety device, the second safety device comprising two abutments which are mutually aligned and fit together to allow movement of the firing pin into the 'Fire' position from the 'Armed' position, but are misaligned and prevent such movement in other relative rotational positions of the second and third members.

* * * * *